US011204613B2

(12) United States Patent
Zhang et al.

(10) Patent No.: US 11,204,613 B2
(45) Date of Patent: Dec. 21, 2021

(54) LDO CIRCUIT DEVICE AND OVERCURRENT PROTECTION CIRCUIT THEREOF

(71) Applicant: Shanghai Huali Microelectronics Corporation, Shanghai (CN)

(72) Inventors: Ning Zhang, Shanghai (CN); Jingping Gu, Shanghai (CN)

(73) Assignee: Shanghai Huali Microelectronics Corporation, Shanghai (CN)

( * ) Notice: Subject to any disclaimer, the term of this patent is extended or adjusted under 35 U.S.C. 154(b) by 11 days.

(21) Appl. No.: 16/800,614

(22) Filed: Feb. 25, 2020

(65) Prior Publication Data

US 2020/0333816 A1 Oct. 22, 2020

(30) Foreign Application Priority Data

Apr. 18, 2019 (CN) ..... 201910311310.8

(51) Int. Cl.
*G05F 1/573* (2006.01)
*G05F 1/46* (2006.01)
*G05F 1/575* (2006.01)

(52) U.S. Cl.
CPC ..... *G05F 1/573* (2013.01); *G05F 1/465* (2013.01); *G05F 1/575* (2013.01)

(58) Field of Classification Search
CPC ..... G05F 1/462; G05F 1/465; G05F 1/468; G05F 1/56; G05F 1/575; G05F 1/562; G05F 1/565; G05F 1/567; G05F 1/569; G05F 1/571; G05F 1/573; G05F 1/5735; H02H 3/08; H02H 3/025; H02H 9/00; H02H 9/001; H02H 9/002; H02H 9/005;
(Continued)

(56) References Cited

U.S. PATENT DOCUMENTS 5,886,570 A * 3/1999 Brokaw ..... G05F 1/575 327/540
5,889,393 A * 3/1999 Wrathall ..... G05F 1/565 323/282

(Continued)

FOREIGN PATENT DOCUMENTS

CN 103392159 A 11/2013
CN 203387479 U 1/2014

(Continued)

OTHER PUBLICATIONS

Jan. 21, 2020—(CN) Search Report Appn 201910311310.8.

*Primary Examiner* — Thienvu V Tran
*Assistant Examiner* — Nusrat Quddus
(74) *Attorney, Agent, or Firm* — Banner & Witcoff, Ltd.

(57) ABSTRACT

Embodiments described herein relate to an LDO circuit device and overcurrent protection circuit of an LDO circuit. An overcurrent protection circuit is added to an LDO circuit to process an output current signal of the LDO circuit. When the output current signal of the LDO circuit increases, a voltage of a gate drive signal of a power switch in the LDO circuit is increased through adjustment performed by the overcurrent protection circuit, thereby declining the current capability of the power switch in the LDO circuit and restricting an output current thereof from continuing to increase. After feedback regulation, the output current of the LDO finally reaches to a stable value.

16 Claims, 3 Drawing Sheets

(58) Field of Classification Search
CPC ..... H02H 9/008; H02H 9/02; H02H 9/021; H02H 9/025; H02H 9/023; H02H 9/026; H02H 9/028
USPC ..... 323/271–289
See application file for complete search history.

(56) References Cited

U.S. PATENT DOCUMENTS 6,046,577 A * 4/2000 Rincon-Mora ..... G05F 1/575 323/279
6,188,211 B1 * 2/2001 Rincon-Mora ..... G05F 1/575 323/273
6,867,573 B1 * 3/2005 Carper ..... G05F 1/573 323/274
9,964,976 B2 * 5/2018 Conte ..... H02M 3/07
10,168,363 B1 * 1/2019 Petenyi ..... H02H 9/025
2003/0085693 A1 * 5/2003 Marty ..... G05F 1/573 323/280
2005/0275394 A1 * 12/2005 Moraveji ..... G05F 1/565 323/312
2007/0241730 A1 * 10/2007 Dow ..... G05F 1/575 323/280
2010/0052635 A1 * 3/2010 Wang ..... G05F 1/575 323/280
2010/0213917 A1 * 8/2010 Pulijala ..... G05F 1/575 323/293
2010/0327834 A1 * 12/2010 Lowe, Jr. ..... G05F 1/56 323/282
2012/0187930 A1 * 7/2012 Williams ..... G05F 1/5735 323/273
2013/0293986 A1 11/2013 Lemer et al.
2015/0130434 A1 * 5/2015 Jain ..... G05F 1/575 323/280
2015/0212530 A1 * 7/2015 Forejtek ..... G05F 1/56 323/280
2015/0362936 A1 * 12/2015 Patel ..... G05F 1/563 323/280
2017/0052553 A1 * 2/2017 Gebeyehu ..... H03F 3/19
2019/0020338 A1 * 1/2019 Chellamuthu ..... H03K 17/145
2019/0079552 A1 * 3/2019 Yasusaka ..... G05F 1/461
2020/0081466 A1 * 3/2020 Ideno ..... G05F 1/575
2021/0058031 A1 * 2/2021 Zhang ..... H03B 5/24
2021/0089068 A1 * 3/2021 Manohar ..... G05F 1/575

FOREIGN PATENT DOCUMENTS

CN 204028740 U 12/2014
CN 106527563 A 3/2017
CN 107943190 A 4/2018

* cited by examiner

LDO CIRCUIT DEVICE AND OVERCURRENT PROTECTION CIRCUIT THEREOF

CROSS REFERENCE TO RELATED APPLICATIONS

The present application claims priority to and the benefit of Chinese Patent Application No. 201910311310.8 filed on Apr. 18, 2019, the disclosure of which is incorporated herein by reference in its entirety as part of the present application.

BACKGROUND

The present disclosure relates to semiconductor integrated circuits, in particular to an LDO circuit device and an overcurrent protection circuit of an LDO circuit.

The low dropout regulator (LDO) refers to a low dropout linear regulator, which is an integrated circuit regulator that usually has extremely low self-noise and a relatively high power supply rejection ratio (PSRR) in comparison with the conventional linear regulators. The LDO is a micro power source system on chip with very low self-consumption, which is widely used due to many advantages thereof.

The high-power switch in the LDO circuit may cause energy accumulation in the tube due to overcurrent during working, which can easily cause an avalanche, thereby damaging the device. Therefore, in practical applications, overcurrent protection has always been the key affecting the reliable and stable operation of power devices. However, the LDO currently common in the market does not have an overcurrent protection function, so an excessively large current may cause irreversible results to devices in the LDO circuit or even the entire system. Accordingly, it can be seen that providing an overcurrent protection structure for the LDO circuit to appropriately control the output current of the LDO, thereby avoiding problems such as the circuit malfunction caused by overcurrent, can be very helpful in improving the reliability of the LDO circuit and improving the application of the LDO in other work environments.

BRIEF SUMMARY

According to embodiments described herein there is provided an LDO circuit device. The LDO circuit device comprises an LDO circuit and an overcurrent protection module, the LDO circuit comprises a first P-type power switch PM1, wherein a source terminal S of the first P-type power switch PM1 is connected to a direct current voltage source VDD, a drain terminal D of the first P-type power switch PM1 is connected to one end of a series structure formed by a first resistor R1 and a first resistor R2, the other end of the series structure formed by the first resistor R1 and the first resistor R2 is grounded, a common node P of the first resistor R1 and the first resistor R2 is connected to a first input end of a first error amplifier to input a feedback voltage signal VFB to the first input end of the first error amplifier, a second input end of the first error amplifier receives a reference voltage VREF, and an output end of the first error amplifier outputs a drive signal Vgate1 of a gate G of the first P-type power switch PM1; and the overcurrent protection module comprises: a second P-type power switch PM2, wherein a source terminal S of the second P-type power switch PM2 is connected to the direct current voltage source VDD, a drain terminal D of the second P-type power switch PM2 is connected to a first input end of a second error amplifier and connected to a drain terminal D of a first N-type power switch NM1, a source terminal S of the first N-type power switch NM1 is grounded through a third resistor R3, a second input end of the second error amplifier receives an output voltage VOUT of the drain terminal D of the first P-type power switch PM1, an output end of the second error amplifier outputs a drive signal Vgate2 of a gate G of the first N-type power switch NM1, and a gate G of the second P-type power switch PM2 is connected to the gate G of the first P-type power switch PM1 to receive the drive signal Vgate1; a second N-type power switch NM2; and a third P-type power switch PM3, wherein a drain terminal D of the second N-type power switch NM2 is connected to the direct current voltage source VDD and connected to a gate G of the third P-type power switch PM3 to output a drive signal Vgate3 of the gate G of the third P-type power switch PM3, a source terminal S of the second N-type power switch NM2 is ground, a gate G of the second N-type power switch NM2 is connected to the source terminal S of the first N-type power switch NM1 to receive a gate drive signal Vgate4 output by the source terminal S of the first N-type power switch NM1, a source terminal S of the third P-type power switch PM3 is connected to the direct current voltage source VDD, and a drain terminal D of the third P-type power switch PM3 is connected to the gate G of the first P-type power switch PM1 and the gate G of the second P-type power switch PM2.

According to embodiments described herein there is provided An overcurrent protection circuit of an LDO circuit, the LDO circuit comprising a first P-type power switch PM1, wherein a source terminal S of the first P-type power switch PM1 is connected to a direct current voltage source VDD, a drain terminal D of the first P-type power switch PM1 is grounded, and a gate G of the first P-type power switch PM1 receives a drive signal Vgate1, the overcurrent protection circuit comprising: a second P-type power switch PM2, wherein a source terminal S of the second P-type power switch PM2 is connected to the direct current voltage source VDD, a drain terminal D of the second P-type power switch PM2 is connected to a first input end of a second error amplifier and connected to a drain terminal D of a first N-type power switch NM1, a source terminal S of the first N-type power switch NM1 is grounded through a third resistor R3, a second input end of the second error amplifier receives an output voltage VOUT of the drain terminal D of the first P-type power switch PM1, an output end of the second error amplifier outputs a drive signal Vgate2 of a gate G of the first N-type power switch NM1, and a gate G of the second P-type power switch PM2 is connected to the gate G of the first P-type power switch PM1 to receive the drive signal Vgate1; a second N-type power switch NM2; and a third P-type power switch PM3, wherein a drain terminal D of the second N-type power switch NM2 is connected to the direct current voltage source VDD and connected to a gate G of the third P-type power switch PM3 to output a drive signal Vgate3 of the gate G of the third P-type power switch PM3, a source terminal S of the second N-type power switch NM2 is ground, a gate G of the second N-type power switch NM2 is connected to the source terminal S of the first N-type power switch NM1 to receive a gate drive signal Vgate4 output by the source terminal S of the first N-type power switch NM1, a source terminal S of the third P-type power switch PM3 is connected to the direct current voltage source VDD, and a drain terminal D of the third P-type power switch PM3 is connected to the gate G of the first P-type power switch PM1 and the gate G of the second P-type power switch PM2.

Figure 1:
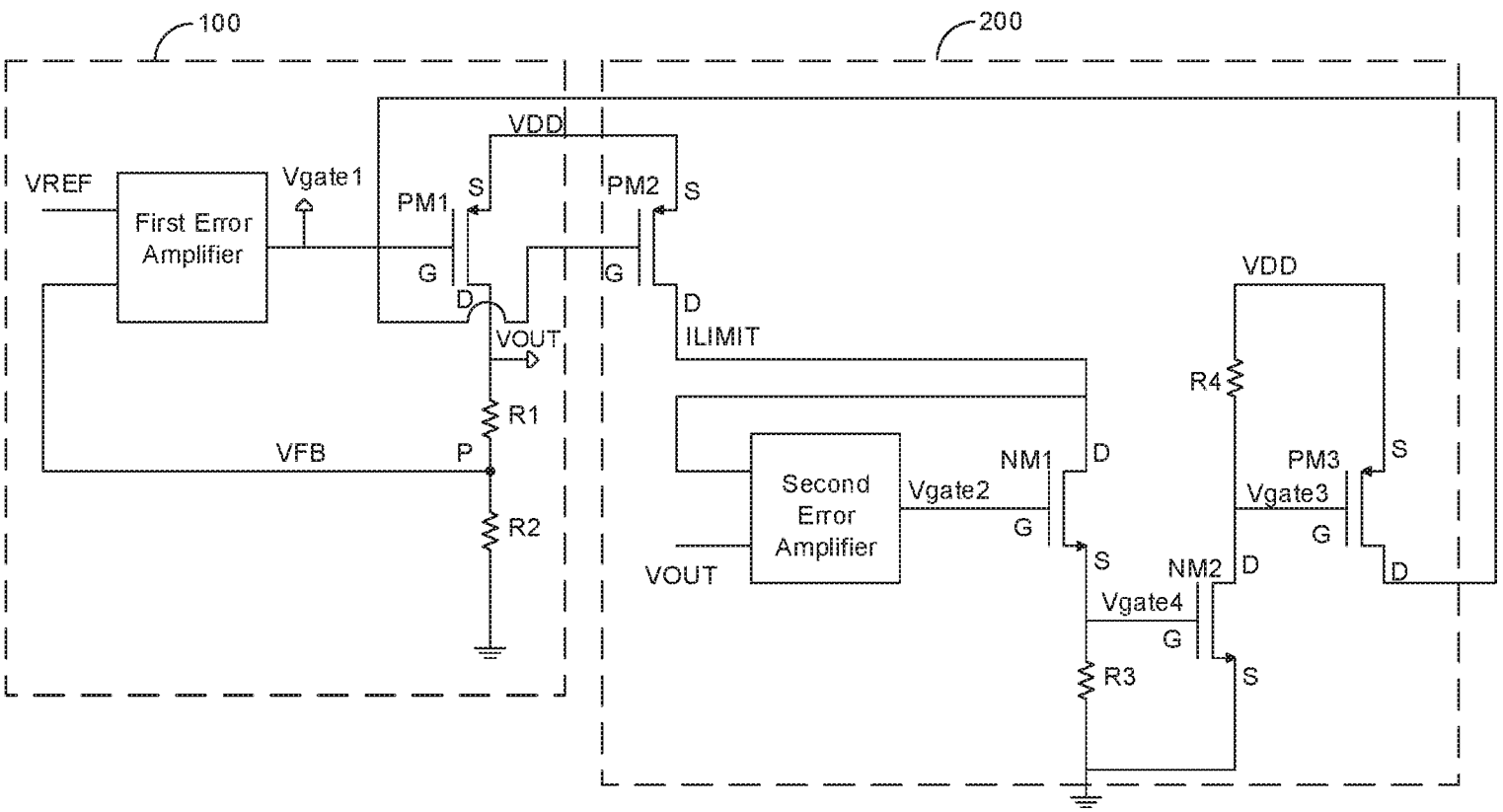
FIG. 1 is a schematic diagram of an LDO circuit device according to one embodiment.

Description of reference signs of main components in the drawings:

100. LDO circuit; 200. overcurrent protection module

DETAILED DESCRIPTION

The technical solution in the present disclosure will be clearly and completely described below with reference to the accompanying drawings. Obviously, the described embodiments are merely some of the embodiments, but not all the embodiments. Based on the embodiments of the present disclosure, all other embodiments obtained by a person of ordinary skill in the art without creative efforts shall fall within the protection scope of the present disclosure.

An embodiment of the present disclosure provides an LDO circuit device. Specifically, referring to FIG. 1, which is a schematic diagram of the LDO circuit device in the embodiment of the present disclosure. As shown in FIG. 1, the LDO circuit device comprises an LDO circuit 100 and an overcurrent protection module 200. The LDO circuit 100 comprises a first P-type power switch PM1, wherein a source terminal S of the first P-type power switch PM1 is connected to a direct current voltage source VDD, a drain terminal D of the first P-type power switch PM1 is connected to one end of a series structure formed by a first resistor R1 and a first resistor R2, the other end of the series structure formed by the first resistor R1 and the first resistor R2 is grounded, a common node P of the first resistor R1 and the first resistor R2 is connected to a first input end of a first error amplifier to input a feedback voltage signal VFB to the first input end of the first error amplifier, a second input end of the first error amplifier receives a reference voltage VREF, and an output end of the first error amplifier outputs a drive signal Vgate1 of a gate G of the first P-type power switch PM1. The series structure formed by the first resistor R1 and the first resistor R2 forms a sampling circuit for an output voltage VOUT of the drain terminal D of the first P-type power switch PM1, and the sampling circuit and the first error amplifier form a negative feedback loop of the LDO circuit 100, so as to adjust the output voltage VOUT of the drain terminal D of the first P-type power switch PM1, wherein the output voltage VOUT of the drain D of the first P-type power switch PM1 is an output voltage of the LDO circuit 100. The overcurrent protection module 200 comprises a second P-type power switch PM2, wherein a source terminal S of the second P-type power switch PM2 is connected to the direct current voltage source VDD, a drain terminal D of the second P-type power switch PM2 is connected to a first input end of a second error amplifier and connected to a drain terminal D of a first N-type power switch NM1, a source terminal S of the first N-type power switch NM1 is grounded through a third resistor R3, a second input end of the second error amplifier receives the output voltage VOUT of the drain terminal D of the first P-type power switch PM1, an output end of the second error amplifier outputs a drive signal Vgate2 of a gate G of the first N-type power switch NM1, and a gate G of the second P-type power switch PM2 is connected to the gate G of the first P-type power switch PM1 to receive the drive signal Vgate1. Specifically, in manufacture of the above LDO circuit device, device sizes (such as the length and width of a channel) of the first P-type power switch PM1 and the second P-type power switch PM2 are set at a certain ratio. Since the size of first P-type power switch PM1 is relatively large and much different from that of the second P-type power switch PM2, clamping needs to be performed at the drain terminals D of the first P-type power switch PM1 and the second P-type power switch PM2, so that a drain terminal voltage of the second P-type power switch PM2 is the same as the drain terminal voltage VOUT of the first P-type power switch PM1. The second error amplifier and the first N-type power switch NM1 form a feedback regulation loop. When the drain terminal voltage of the second P-type power switch PM2 is lower than VOUT, Vgate2 output by the second error amplifier is reduced, so as to increase resistance of the first N-type power switch NM1, thereby increasing the drain terminal voltage of the second P-type power switch PM2. After repeated regulation, the drain terminal voltage of the second P-type power switch PM2 is the same as the drain terminal voltage of the first P-type power switch PM1, so that a drain terminal current Ilimit of the second P-type power switch PM2 corresponds to an output current (that is, an output current of the above LDO circuit device) at the drain terminal of the first P-type power switch PM1, that is, the drain terminal current Ilimit of the second P-type power switch PM2 mirrors the output current of the above LDO circuit device. Further, the overcurrent protection module 200 comprises a second N-type power switch NM2 and a third P-type power switch PM3, wherein a drain terminal D of the second N-type power switch NM2 is connected to the direct current voltage source VDD and connected to a gate G of the third P-type power switch PM3 to output a drive signal Vgate3 of the gate G of the third P-type power switch PM3, a source terminal S of the second N-type power switch NM2 is ground, a gate G of the second N-type power switch NM2 is connected to the source terminal S of the first N-type power switch NM1 to receive a gate drive signal Vgate4 output by the source terminal S of the first N-type power switch NM1, a source terminal S of the third P-type power switch PM3 is connected to the direct current voltage source VDD, and a drain terminal D of the third P-type power switch PM3 is connected to the gate G of the first P-type power switch PM1 and the gate G of the second P-type power switch PM2. Specifically, when a current passing through the first P-type power switch PM1 increases, the Ilimit current of the second P-type power switch PM2 obtained by means of mirroring increases therewith, thereby increasing a voltage drop across the third resistor R3, that is, a voltage of the drive signal Vgate4 is increased, a gate drive voltage of the second N-type power switch NM2 is increased, and the second N-type power switch NM2 is gradually brought into a conducting state. When the current passing through the first P-type power switch PM1 reaches to a certain value, the second N-type power switch NM2 becomes conducting, and a gate voltage of the third P-type power switch PM3 is pulled down, that is, a voltage of the drive signal Vgate3 is low, the third P-type power switch PM3 is conducting, and an output voltage at the D terminal of the third P-type power switch PM3 is increased, thereby declining the current capability of the first P-type power switch PM1 and restricting the output current thereof from continuing to increase. After repeated regulation, the output current of the LDO finally reaches to a stable value, that is, a current-limiting point of the LDO.

Figure 2:
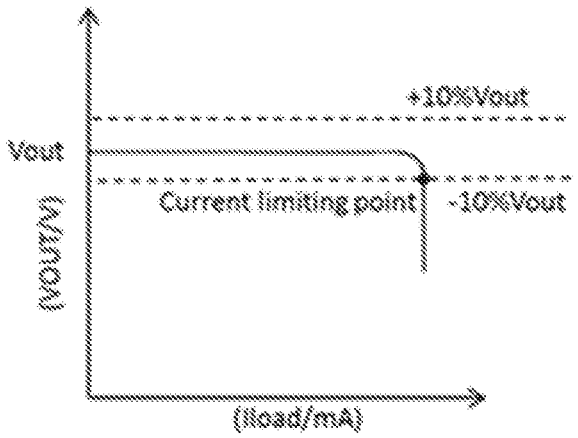
FIG. 2 is a schematic diagram of a simulation result of the LDO circuit device shown in FIG. 1.

Specifically, referring to FIG. 2, which is a schematic diagram of a simulation result of the LDO circuit device shown in FIG. 1. As shown in FIG. 2, when an output load current Iload (that is, the output current at the drain terminal of the first P-type power switch PM1) continues to increase, the output voltage of the LDO is first maintained at an output voltage VOUT. When the load current increases to a certain value, VOUT begins to decrease, and when VOUT decreases to −10% of a normal working voltage (which can be determined according to design requirements of the LDO), the output load current Iload no longer increases, and a current value in this case is the current-limiting point. In this case, the output current of the LDO does not increase with the increase of the applied load current, thereby achieving an overcurrent protection function.

Figure 3:
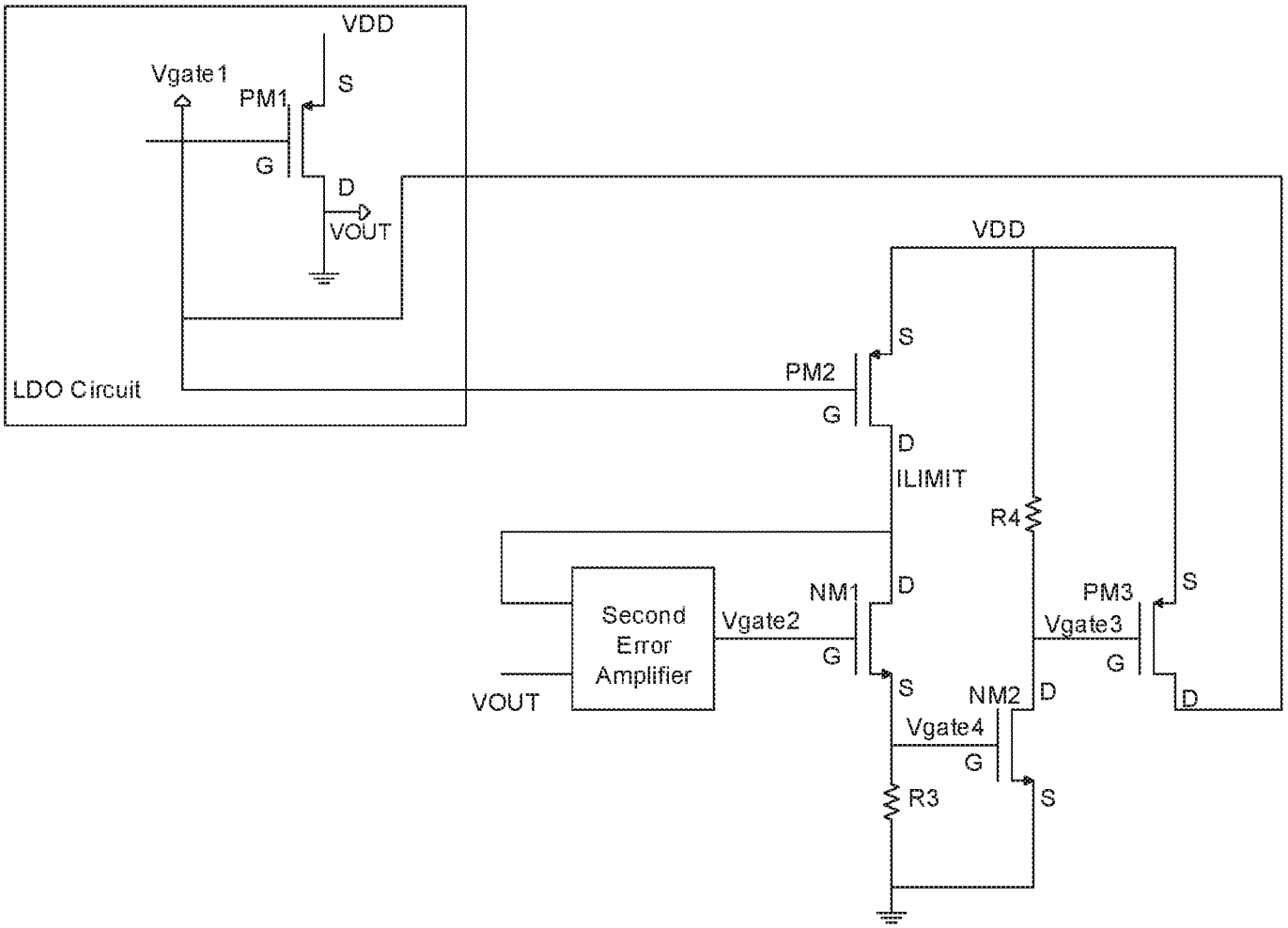
FIG. 3 is a schematic diagram of an overcurrent protection circuit of an LDO circuit according to one embodiment.

Another embodiment of the present disclosure further provides an overcurrent protection circuit of an LDO circuit. Specifically, referring to FIG. 3, which is a schematic diagram of the overcurrent protection circuit of an LDO circuit in the embodiment of the present disclosure. As shown in FIG. 3, the LDO circuit comprises a first P-type power switch PM1, wherein a source terminal S of the first P-type power switch PM1 is connected to a direct current voltage source VDD, a drain terminal D of the first P-type power switch PM1 is grounded, and a gate G of the first P-type power switch PM1 receives a drive signal Vgate1. The overcurrent protection circuit provided by the present disclosure comprises: a second P-type power switch PM2, wherein a source terminal S of the second P-type power switch PM2 is connected to the direct current voltage source VDD, a drain terminal D of the second P-type power switch PM2 is connected to a first input end of a second error amplifier and connected to a drain terminal D of a first N-type power switch NM1, a source terminal S of the first N-type power switch NM1 is grounded through a third resistor R3, a second input end of the second error amplifier receives an output voltage VOUT of the drain terminal D of the first P-type power switch PM1, an output end of the second error amplifier outputs a drive signal Vgate2 of a gate G of the first N-type power switch NM1, and a gate G of the second P-type power switch PM2 is connected to the gate G of the first P-type power switch PM1 to receive the drive signal Vgate1. Specifically, in manufacture of the above LDO circuit and overcurrent protection circuit, device sizes (such as the length and width of a channel) of the first P-type power switch PM1 and the second P-type power switch PM2 are set at a certain ratio. Since the size of first P-type power switch PM1 is relatively large and much different from that of the second P-type power switch PM2, clamping needs to be performed at the drain terminals D of the first P-type power switch PM1 and the second P-type power switch PM2, so that a drain terminal voltage of the second P-type power switch PM2 is the same as the drain terminal voltage VOUT of the first P-type power switch PM1. The second error amplifier and the first N-type power switch NM1 form a feedback regulation loop. When the drain terminal voltage of the second P-type power switch PM2 is lower than VOUT, Vgate2 output by the second error amplifier is reduced, so as to increase resistance of the first N-type power switch NM1, thereby increasing the drain terminal voltage of the second P-type power switch PM2. After repeated regulation, the drain terminal voltage of the second P-type power switch PM2 is the same as the drain terminal voltage of the first P-type power switch PM1, so that a drain terminal current Ilimit of the second P-type power switch PM2 corresponds to an output current (that is, an output current of the above LDO circuit device) at the drain terminal of the first P-type power switch PM1, that is, the drain terminal current Ilimit of the second P-type power switch PM2 mirrors the output current of the above LDO circuit device. Further, the overcurrent protection circuit comprises a second N-type power switch NM2 and a third P-type power switch PM3, wherein a drain terminal D of the second N-type power switch NM2 is connected to the direct current voltage source VDD through a fourth resistor R4 and connected to a gate G of the third P-type power switch PM3 to output a drive signal Vgate3 of the gate G of the third P-type power switch PM3, a source terminal S of the second N-type power switch NM2 is ground, a gate G of the second N-type power switch NM2 is connected to the source terminal S of the first N-type power switch NM1 to receive a gate drive signal Vgate4 output by the source terminal S of the first N-type power switch NM1, a source terminal S of the third P-type power switch PM3 is connected to the direct current voltage source VDD, and a drain terminal D of the third P-type power switch PM3 is connected to the gate G of the first P-type power switch PM1 and the gate G of the second P-type power switch PM2. Specifically, when a current passing through the first P-type power switch PM1 increases, the Ilimit current of the second P-type power switch PM2 obtained by means of mirroring increases therewith, thereby increasing a voltage drop across the third resistor R3, that is, a voltage of the drive signal Vgate4 is increased, a gate drive voltage of the second N-type power switch NM2 is increased, and the second N-type power switch NM2 is gradually brought into a conducting state. When the current passing through the first P-type power switch PM1 reaches to a certain value, the second N-type power switch NM2 becomes conducting, and a gate voltage of the third P-type power switch PM3 is pulled down, that is, a voltage of the drive signal Vgate3 is low, the third P-type power switch PM3 is conducting, and an output voltage at the D terminal of the third P-type power switch PM3 is increased, thereby declining the current capability of the first P-type power switch PM1 and restricting the output current thereof from continuing to increase. After repeated regulation, the output current of the LDO finally reaches to a stable value, that is, a current-limiting point of the LDO.

In an embodiment of the present disclosure, the first end of the first error amplifier is an inverting input end, and the second end of the first error amplifier is a non-inverting input end. More specifically, in an embodiment of the present disclosure, the first error amplifier is an operational amplifier.

In an embodiment of the present disclosure, the first end of the second error amplifier is a non-inverting input end, and the second end of the second error amplifier is an inverting input end. More specifically, in an embodiment of the present disclosure, the second error amplifier is an operational amplifier.

In an embodiment of the present disclosure, the drain terminal D of the second N-type power switch NM2 is connected to the direct current voltage source VDD through the fourth resistor R4.

In an embodiment of the present disclosure, the first P-type power switch PM1, the second P-type power switch PM2, and the third P-type power switch PM3 are PMOS.

In an embodiment of the present disclosure, the first N-type power switch NM1 and the second N-type power switch NM2 are NMOS.

In an embodiment of the present disclosure, the above LDO circuit device and overcurrent protection circuit of an LDO circuit are integrated in one semiconductor substrate, respectively.

To sum up, an overcurrent protection circuit is added to an LDO circuit to process an output current signal of the LDO circuit. When the output current signal of the LDO circuit increases, a voltage of a gate drive signal of a power switch in the LDO circuit is increased through adjustment performed by the overcurrent protection circuit, thereby declining the current capability of the power switch in the LDO circuit and restricting an output current thereof from continuing to increase. After feedback regulation, the output current of the LDO finally reaches to a stable value, thereby achieving the purpose of overcurrent protection, improving the reliability and stability of the LDO circuit, and increasing the application environment range thereof.

Finally, it should be noted that the above embodiments are merely used for illustration of the technical solution of the present disclosure, but not for limitation. Although the present disclosure is described in detail with reference to the embodiments, those skilled in the art should understand that, they can still make modifications to the technical solutions described in the embodiments, or make equivalent replacements to some or all of the technical features, while these modifications or replacements shall not deviate the essence of the corresponding technical solutions from the range of the technical solutions of the embodiments of the present disclosure.

What is claimed is:

1. A low dropout regulator (LDO) circuit device, comprising:

an LDO circuit comprising a first P-type power switch PM1, wherein a source terminal S of the first P-type power switch PM1 is connected to a direct current voltage source VDD, a drain terminal D of the first P-type power switch PM1 is connected to one end of a series structure formed by a first resistor R1 and a second resistor R2, the other end of the series structure formed by the first resistor R1 and the second resistor R2 is grounded, a common node P of the first resistor R1 and the second resistor R2 is connected to a first input end of a first error amplifier to input a feedback voltage signal VFB to the first input end of the first error amplifier, a second input end of the first error amplifier receives a reference voltage VREF, and an output end of the first error amplifier outputs a drive signal Vgate1 to a gate G of the first P-type power switch PM1; and an overcurrent protection module comprising: a second P-type power switch PM2, wherein a source terminal S of the second P-type power switch PM2 is connected to the direct current voltage source VDD, a drain terminal D of the second P-type power switch PM2 is connected to a first input end of a second error amplifier and connected to a drain terminal D of a first N-type power switch NM1, a source terminal S of the first N-type power switch NM1 is grounded through a third resistor R3, a second input end of the second error amplifier receives an output voltage VOUT of the drain terminal D of the first P-type power switch PM1, an output end of the second error amplifier outputs a drive signal Vgate2 to a gate G of the first N-type power switch NM1, and a gate G of the second P-type power switch PM2 is connected to the gate G of the first P-type power switch PM1 to receive the drive signal Vgate1; a second N-type power switch NM2; and a third P-type power switch PM3, wherein a drain terminal D of the second N-type power switch NM2 is connected to the direct current voltage source VDD and connected to a gate G of the third P-type power switch PM3 to output a drive signal Vgate3 to the gate G of the third P-type power switch PM3, a source terminal S of the second N-type power switch NM2 is ground, a gate G of the second N-type power switch NM2 is connected to the source terminal S of the first N-type power switch NM1 to receive a gate drive signal Vgate4 output by the source terminal S of the first N-type power switch NM1, a source terminal S of the third P-type power switch PM3 is connected to the direct current voltage source VDD, and a drain terminal D of the third P-type power switch PM3 is connected to the gate G of the first P-type power switch PM1 and to the gate G of the second P-type power switch PM2.

2. The LDO circuit device according to claim 1, wherein the first input end of the first error amplifier is an inverting input end, and the second input end of the first error amplifier is a non-inverting input end.

3. The LDO circuit device according to claim 2, wherein the first error amplifier is an operational amplifier.

4. The LDO circuit device according to claim 1, wherein the first input end of the second error amplifier is a non-inverting input end, and the second input end of the second error amplifier is an inverting input end.

5. The LDO circuit device according to claim 4, wherein the second error amplifier is an operational amplifier.

6. The LDO circuit device according to claim 1, wherein the drain terminal D of the second N-type power switch NM2 is connected to the direct current voltage source VDD through a fourth resistor R4.

7. The LDO circuit device according to claim 1, wherein the first P-type power switch PM1, the second P-type power switch PM2, and the third P-type power switch PM3 are PMOS.

8. The LDO circuit device according to claim 1, wherein the first N-type power switch NM1 and the second N-type power switch NM2 are NMOS.

9. The LDO circuit device according to claim 1, wherein the LDO circuit device is integrated in one semiconductor substrate.

10. An overcurrent protection circuit of a low dropout regulator (LDO) circuit, the LDO circuit comprising a first P-type power switch PM1, wherein a source terminal S of the first P-type power switch PM1 is connected to a direct current voltage source VDD, a drain terminal D of the first P-type power switch PM1 is grounded, and a gate G of the first P-type power switch PM1 receives a drive signal Vgate1, the overcurrent protection circuit comprising: a second P-type power switch PM2, wherein a source terminal S of the second P-type power switch PM2 is connected to the direct current voltage source VDD, a drain terminal D of the second P-type power switch PM2 is connected to a first input end of a second error amplifier and connected to a drain terminal D of a first N-type power switch NM1, a source terminal S of the first N-type power switch NM1 is grounded through a third resistor R3, a second input end of the second error amplifier receives an output voltage VOUT of the drain terminal D of the first P-type power switch PM1, an output end of the second error amplifier outputs a drive signal Vgate2 to a gate G of the first N-type power switch NM1, and a gate G of the second P-type power switch PM2 is connected to the gate G of the first P-type power switch PM1 to receive the drive signal Vgate1; a second N-type power switch NM2; and a third P-type power switch PM3, wherein a drain terminal D of the second N-type power switch NM2 is connected to the direct current voltage source VDD and connected to a gate G of the third P-type power switch PM3 to output a drive signal Vgate3 to the gate G of the third P-type power switch PM3, a source terminal S of the second N-type power switch NM2 is ground, a gate G of the second N-type power switch NM2 is connected to the source terminal S of the first N-type power switch NM1 to receive a gate drive signal Vgate4 output by the source terminal S of the first N-type power switch NM1, a source terminal S of the third P-type power switch PM3 is connected to the direct current voltage source VDD, and a drain terminal D of the third P-type power switch PM3 is connected to the gate G of the first P-type power switch PM1 and to the gate G of the second P-type power switch PM2.

11. The overcurrent protection circuit of the LDO circuit according to claim 10, wherein the first input end of the second error amplifier is a non-inverting input end, and the second input end of the second error amplifier is an inverting input end.

12. The overcurrent protection circuit of the LDO circuit according to claim 11, wherein the second error amplifier is an operational amplifier.

13. The overcurrent protection circuit of the LDO circuit according to claim 10, wherein the drain terminal D of the second N-type power switch NM2 is connected to the direct current voltage source VDD through a fourth resistor R4.

14. The overcurrent protection circuit of the LDO circuit according to claim 10, wherein the first P-type power switch PM1, the second P-type power switch PM2, and the third P-type power switch PM3 are PMOS.

15. The overcurrent protection circuit of the LDO circuit according to claim 10, wherein the first N-type power switch NM1 and the second N-type power switch NM2 are NMOS.

16. The overcurrent protection circuit of the LDO circuit according to claim 10, wherein the overcurrent protection circuit of the LDO circuit is integrated in one semiconductor substrate.

* * * * *